US006037909A

United States Patent [19]

Cherrette

[11] Patent Number: 6,037,909

[45] Date of Patent: Mar. 14, 2000

[54] DEPLOYED PAYLOAD FOR A COMMUNICATIONS SPACECRAFT

[75] Inventor: Alan R. Cherrette, Los Altos, Calif.

[73] Assignee: Space Systems/Loral, Inc., Palo Alto, Calif.

[21] Appl. No.: 08/823,788

[22] Filed: Mar. 21, 1997

[51] Int. Cl.[7] ..... H01Q 21/00; H01Q 13/10

[52] U.S. Cl. ..... 343/771; 343/700 MS; 343/915; 343/DIG. 2; 343/853

[58] Field of Search ..... 343/770, 771, 343/700 MS, 915, 916, 872, DIG. 2, 853; H01Q 21/00, 13/10

[56] References Cited

U.S. PATENT DOCUMENTS

| | | | |
|---|---|---|---|
| 5,293,171 | 3/1994 | Cherrette | 343/700 MS |
| 5,327,150 | 7/1994 | Cherrette | 343/770 |
| 5,870,063 | 2/1999 | Cherrette et al. | 343/700 MS |

*Primary Examiner*—Hoanganh Le
*Attorney, Agent, or Firm*—Perman & Green, LLP

[57] ABSTRACT

The integration of traveling wave tube amplifiers and multiplexers onto passive transmit array antenna panels deployed out board of a spacecraft bus to simultaneously provide a spacecraft transponder that permits antenna pattern flexibility in orbit, high DC to RF power conversion efficiency, facilitates higher spacecraft power and provides a spacecraft with deployed payload panel architecture having multiple independent beams that can be electronically reconfigured on the ground or in orbit.

10 Claims, 5 Drawing Sheets

DEPLOYED PAYLOAD FOR A COMMUNICATIONS SPACECRAFT

BACKGROUND OF THE INVENTION

1. Field of the Invention

The present invention relates to communication systems, and more particularly to radio frequency communications between the two or more distant users via a radio frequency transponder or payload that is attached to a satellite orbiting the Earth.

2. Background Art

In conventional three axis communications spacecraft the radio frequency transponders (or "the payload") on the spacecraft consist of a receiving reflector antenna (usually a shaped reflector) that forms the radiation pattern for reception of electromagnetic signals. The received signals are amplified with a low noise amplifier and then are frequency converted to the transmit frequency. The frequency converted signals are passed through a demultiplexer that separates the various received signals into their respective frequency bands. The separated signals are amplified by traveling wave tube amplifiers (TWTAs), one for each frequency band and are combined in a multiplexer to form the high power transmit signal—the high power signal is passed through a transmit reflector antenna (usually a shaped reflector) that forms the transmit radiation pattern.

The large heat dissipating equipment (i.e. the TWTAs and multiplexer) in the transponder are usually located in the spacecraft bus on the north and south thermal radiating panels of the spacecraft. The transmit and receive reflector antenna are usually deployed outboard from the east and west sides of the spacecraft bus.

SUMMARY OF THE INVENTION

There are three basic problems with conventional satellite transponders of the type described. The first problem is that as the spacecraft power capability is increased the dissipated heat generated by the spacecraft also increases. The only way dissipated heat can be rejected from a spacecraft of the type described is by radiation from the north and south thermal radiating panels. Since the amount of heat that can be radiated is proportional to the area of the thermal radiating panels, the spacecraft must get larger as the spacecraft power is increased. This causes problems with fitting the satellite in the launch vehicle faring.

The second problem is that the shaped reflector antennas (or the array fed reflector antennas) that are commonly used on spacecraft of the type described have radiation patterns that can not be readily changed in orbit. Antenna coverage requirements are usually selected one to two years before the satellite launch. Since many operators of commercial communications satellites do not know exactly what the market requirements will be in three to five years, they must guess what the antenna pattern requirements will be and hope they don't change much over the ten to fifteen year spacecraft life. This is very risky financially. Having antenna radiation patterns that can be reconfigured in orbit would be very attractive to satellite operators.

The third problem is that conventional spacecraft transponders of the type described have custom designed antenna systems that change with each application. Eliminating such custom designed components will allow standardization of design and stock piling of parts which in turn can reduce delivery time. Reducing delivery time is also very attractive to satellite operators.

Solutions to the three problems described above exist in the known prior art. These solutions involve the use of a deployed active array antenna. Active array antennas are distinguished by having a Solid State Power Amplifier (SSPA) at every individually phase weighted antenna element in the array. This is opposed to passive array antennas which have no means of RF power amplification in the array.

Examples of deployed active array antenna solutions include U.S. Pat. Nos. 5,327,150 and 5,293,171 and the related U.S. Pat. No. 4,987,425. These patents adapt deployed array antenna technology originally developed for space radar and apply it to geostationary communications satellites. The deployed active array antenna technology as described in the aforesaid patents may also use deployed passive array antenna technology that has been used in several operational spacecraft including the U.S. SEASAT satellite and Canada's RADARSAT satellites.

More particularly, U.S. Pat. No. 5,327,150 issued Jul. 5, 1994 to Cherrette entitled "PHASED ARRAY ANTENNA FOR EFFICIENT RADIATION OF MICROWAVE AND THERMAL ENERGY" discloses an active phased array antenna that includes a plurality of subarrays having an upper RF radiating panel assembly including a plurality of radiating waveguides and a feed waveguide. RF radiating slots are cut into one wall of each of the radiating waveguide and a mirror with corresponding slot is bonded to the outside surface. The array further includes a non-RF radiating lower support panel assembly with a mirror bonded to the outside face. The mirrors efficiently radiate thermal energy in the presence of sunlight. An active electronics module is mounted in a housing, and includes an RF probe. The module is supplied with RF signals, control signals and DC bias voltage over transmission lines contained in a multilayered circuit board. RF energy emitted by the probe is coupled from the feed waveguide to the radiating waveguides. Heat generated by the electronics module is conducted through the housing of the active electronics modules and transferred to the outer surfaces of the upper and lower panel assemblies where it is radiated into cold space.

U.S. Pat. No. 5,293,171 issued Mar. 8, 1994 to Cherrette entitled: PHASED ARRAY ANTENNA FOR EFFICIENT RADIATION OF HEAT AND ARBITRARILY POLARIZED MICROWAVE SIGNAL POWER discloses an active phased array antenna panel that radiates heat and arbitrarily polarized microwave signal power. The active array panel also reflects solar power to minimize solar heating. The active array panel includes a plurality of subarray elements each of which includes a plurality of aperture coupled patch radiators. The exterior surface of the subarray element is covered with mirrors to provide efficient radiation of heat in the presence of sunlight. A microstrip feed network in the subarray element is embedded in a dielectric material with a high thermal conductivity to efficiently distribute heat. The active array further includes an electronics module for each subarray element. The electronics module contains a solid state power amplifier, phase shifter and associated electronics mounted in a housing made of material with high thermal conductivity. Each electronics module and corresponding subarray element are thermally and electrically connected to each other and to a support structure assembly with mirrors bonded to the lower exterior surface. Heat generated by the circuits in the electronics module is conducted through the housing and transferred to the outer surfaces of the subarray element and support structure assemblies where it is radiated into space.

U.S. Pat. No. 4,987,423 issued Jan. 22, 1991 to Zahn et al. entitled ANTENNA SUPPORT STRUCTURE discloses a carrying structure of an active antenna that uses fiber reinforced synthetic material in which heat conductive elements and/or elements conducting electromagnetic waves are integrated into the support structure for the antenna.

The biggest problem with the deployed active array antenna solution is that SSPA saturated efficiency is very low and in many cases the SSPAs must be operated linear by which further reduces efficiency. A typical deployed active array payload for geostationary satellite communications may require more than twice as much DC power as a conventional payload for the same application. Another problem is that to produce and package the large number of SSPAs as required for this type of payload, a major development effort would be needed.

An object of the present invention is to provide a transponder (payload) for communications spacecraft that overcomes the aforesaid three problems associated with conventional payloads.

Another object of the present invention is to provide a payload on a spacecraft that does not require deployed active array technology.

Still another object of the present invention is to provide the integration of conventional TWTAs and multiplexers onto passive transmit array antenna panels and deploying these panels out board of a spacecraft bus.

A further object of the present invention is to simultaneously provide a spacecraft transponder that permits antenna pattern flexibility in orbit, high DC to RF power conversion efficiency, facilitates higher spacecraft power and helps reduce satellite delivery time.

Still another object of the present invention is to provide a spacecraft with deployed payload panel architecture with multiple independent beams that can be electronically reconfigured on the ground or in orbit.

A still further object of the present invention is to provide a spacecraft on which the deployed payload is constructed from modular deployed panels that radiate all internally generated heat and are thermally isolated from the spacecraft bus such that payload power does not depend on bus size and can be increased by deploying more payload panels.

Other and further features, advantages and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention and, together with the description, serve to explain the principles of the invention in general terms. Like numerals refer to like parts throughout the disclosure.

DESCRIPTION OF THE INVENTION

Figure 1:
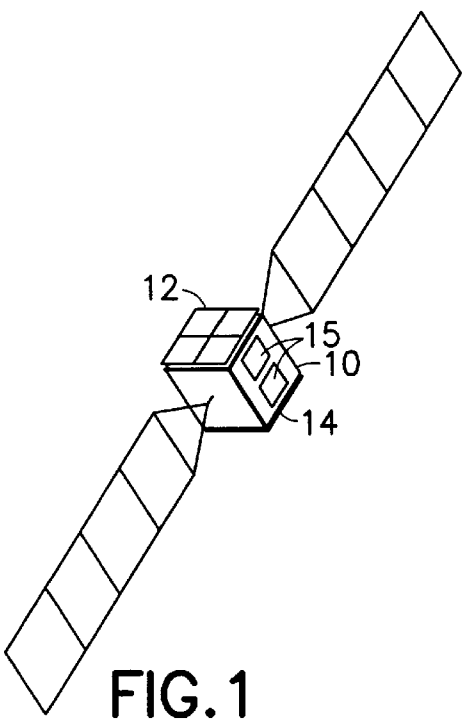
FIGS. 1, 2 and 3 are illustrations showing how the deployed payload of the present invention is attached to a spacecraft.
Figure 2:
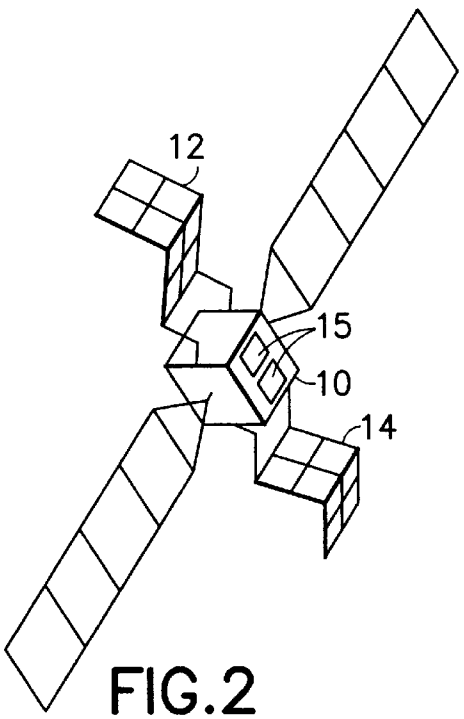
Figure 3:
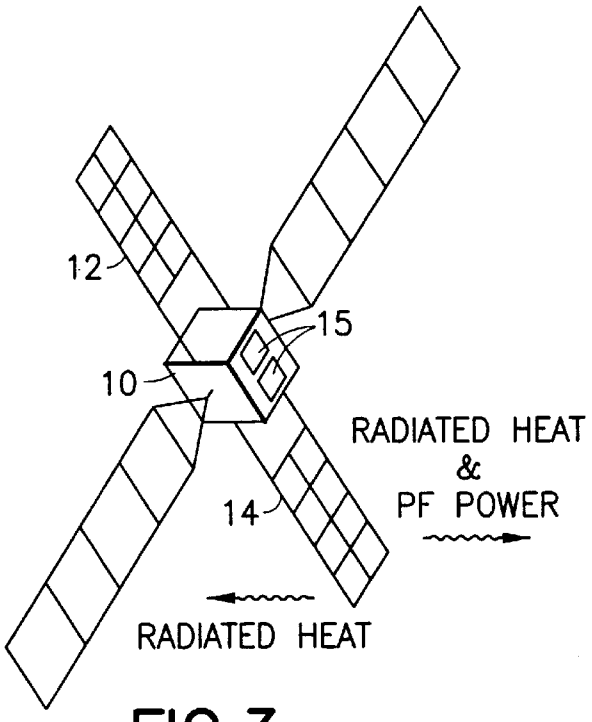

FIGS. 1, 2 and 3 are illustrations that conceptually show how a deployed payload is attached to a spacecraft 10. In FIG. 1, the payload panels 12 and 14 are shown stored. FIG. 2 shows the panels 12 and 14 partially deployed from spacecraft 10 and FIG. 3 shows panels 12 and 14 fully deployed from spacecraft 10. Payload panels 12 and 14 are deployed from the east and west sides of the spacecraft in a manner similar to the deployment of the solar arrays. In the stowed configuration of FIG. 1, multiple payload panels can be stacked along the east and west sides of the spacecraft bus.

Payload panels 12 and 14 are composed of one or more passive array transmit antennas that use ferrite phase shifters to electronically control the antenna radiation pattern shape. The array antenna structure is used to support TWTAs and multiplexers and performs both thermal and RF radiating functions. Standardized panels with standard mechanical interfaces can be designed for C band, Ku band or Ka band. By selecting the number and type of panels used, many payload configurations are possible including hybrid C/Ku band payloads.

An active array receive antenna 15 can be employed to produce multiple reconfigurable antenna patterns for the up link. The active receive array 15 can be mounted on the nadir facing panel of the spacecraft as shown in FIGS. 1, 2 or 3 or they can be on deployed panels 12 and 14.

FIG. 4 through FIG. 9 show the construction detail for a Ku band transmit panel. It will be obvious to those versed in the art that the same design principles can be extended to lower frequencies like C band or higher frequencies such as Ka band.

Figure 4:
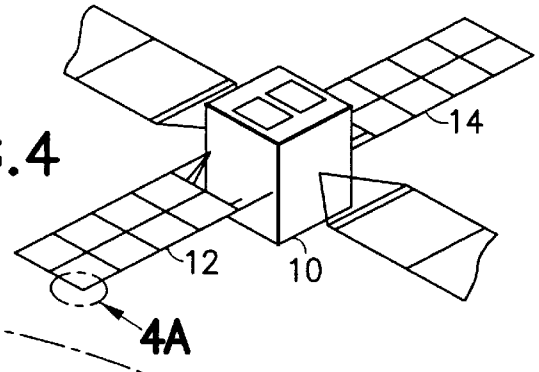
FIG. 4 is an illustration of a section of a deployed passive phased array panel.
Figure 4A:
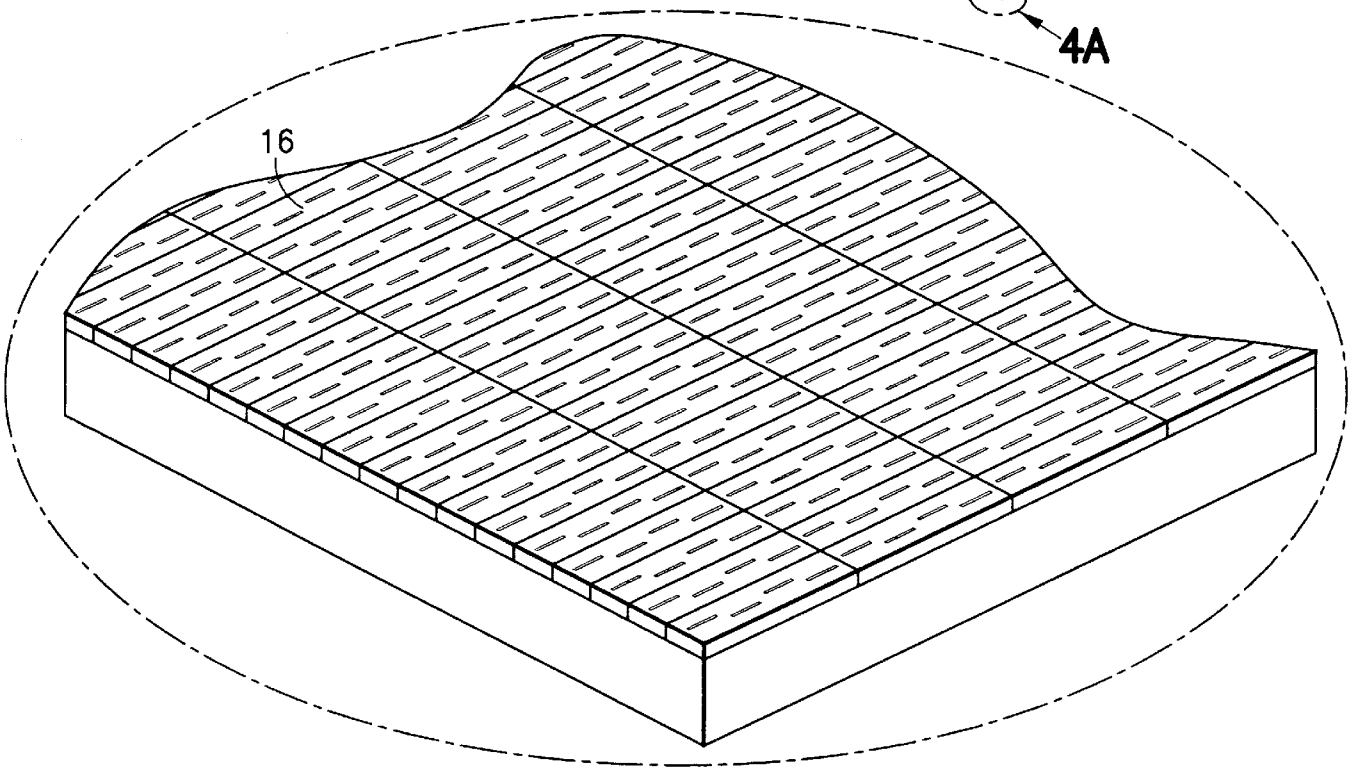

FIG. 4 shows an illustration of a section of a Ku band transmit panel that uses waveguide fed slot radiators 16 for the RF radiating surface. The RF radiating surface is coated with a thermal control material that has high thermal emissivity and low solar absorption so that it can efficiently radiate dissipated heat in the presence of sunlight. This material may be optical solar reflecting mirrors, or various type of thermal control paints. The back surface of the panel (not visible in FIG. 4) may be coated with a similar thermal control material as the front RF radiating surface.

Figure 5:
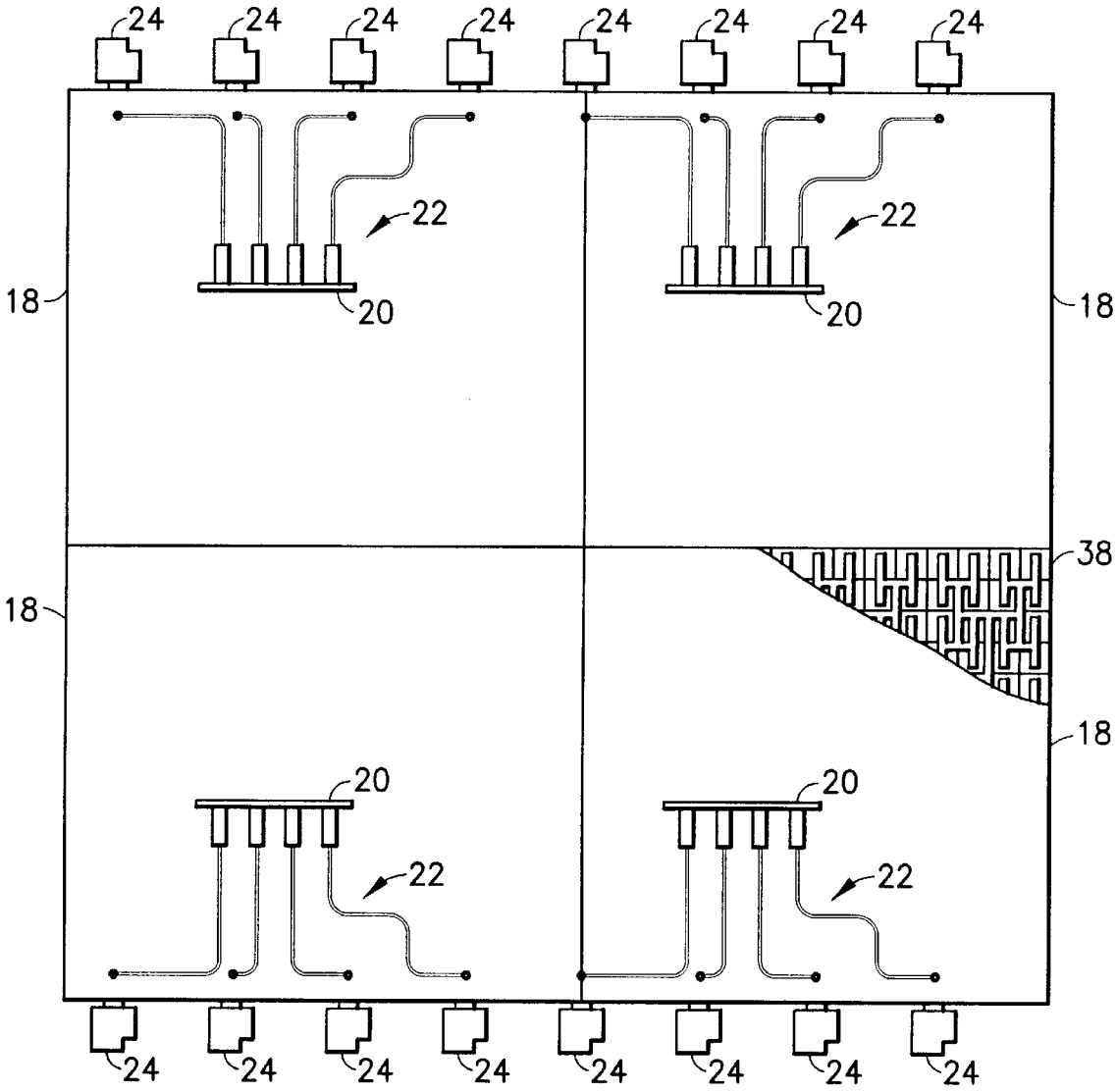
FIGS. 5 and 6 are illustrations of a back surface and an end view of passive phased array antenna panel.

FIG. 5 shows a view of the back surface of a Ku band transmit panel. The back surface includes four transmit arrays 18 each comprising a four channel multiplexer 20 and four waveguides 22. There are a total of sixteen waveguides on the panel surface that connect the four multiplexers to sixteen TWTAs 24.

Figure 6:
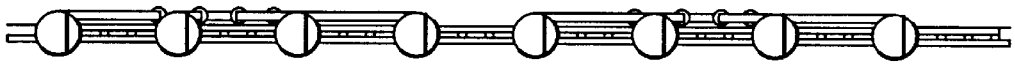

FIG. 6 is an illustration of the end view of the panel of FIG. 5. In this particular embodiment the panel is 8 ft. by 8 ft. and is composed of the four 4 ft. Ku band transmit arrays 18. Each 4 ft. by 4 ft. transmit array is fed by four radiatively cooled TWTAs 24 that have their individual output signal power combined in a four channel multiplexer 20.

FIG. 5 also illustrates a section of the back thermal radiating surface of one 4 ft. by 4 ft. transmit array 38 partially removed so that the construction details of the passive array antenna are visible.

Figure 7:
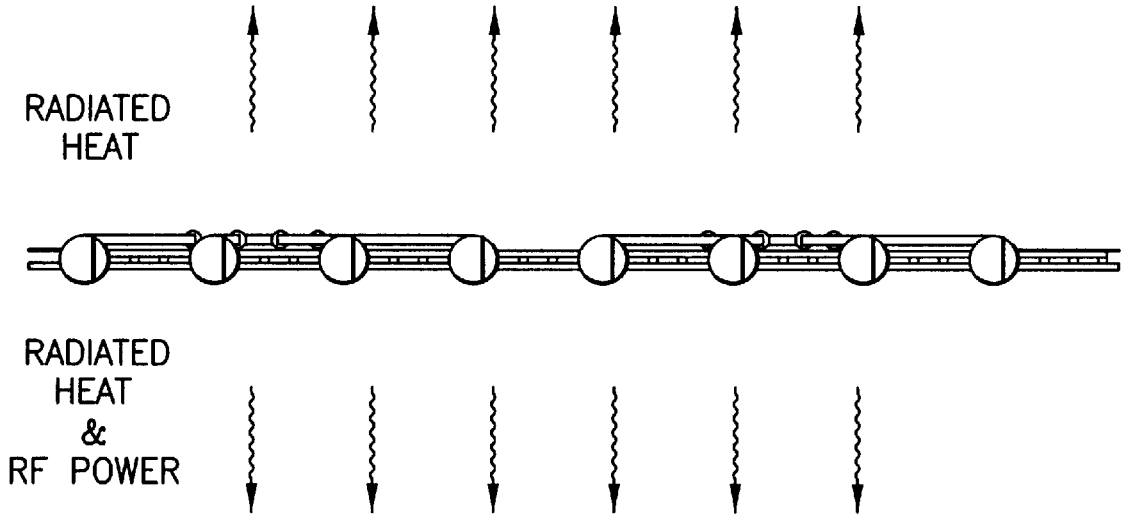
FIG. 7 is an illustration depicting how a deployed passive phased array antenna panel radiates all internally generated heat and RF power out the front and back surfaces.

FIG. 7 depicts the flow of radiated heat from both the front and back surfaces of the Ku band transmit panel of FIGS. 5 and 6. FIG. 7 also depicts the flow of RF radiation from the front side of the panel.

Figure 8:
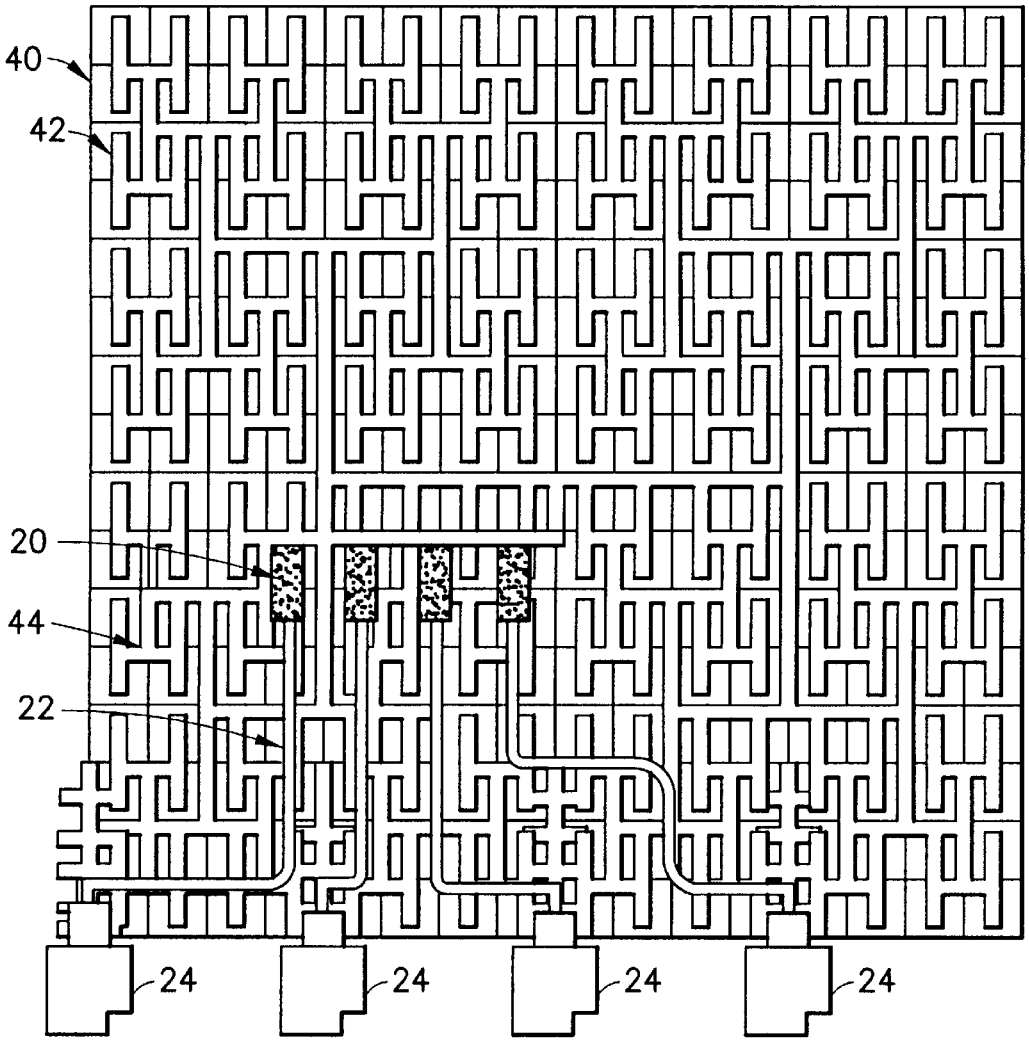
FIGS. 8 and 9 are back and side views of a more detailed illustration of a quarter section of a deployed passive phased array panel containing one phased array antenna.
Figure 9:
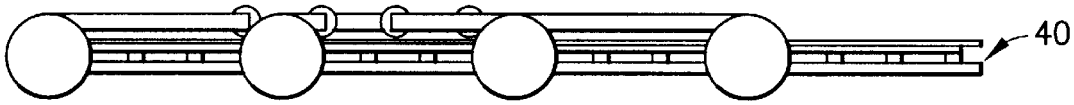

FIG. 8 and FIG. 9 show a more detailed illustration of the back and end views of the 4 ft. by 4 ft. transmit array antenna with the back thermal radiating surface fully removed. The 4 ft. by 4 ft. Ku band transmit array shown in FIG. 8 is composed of two hundred and fifty six array antenna elements 40 that use two hundred and fifty six ferrite phase shifters 42 to electronically control the antenna radiating pattern shape. In this particular embodiment the antenna element is a slotted waveguide subarray consisting of sixteen slots arranged in four rows of four slots. The assembly of slotted waveguide subarray elements can be manufactured together in one large piece using standard dip braze manufacturing techniques.

The slotted waveguide subarray elements 40 in FIGS. 8 and 9 are fed by a ferrite phase shifter modules 42. The phase shifter modules 42 are in turn fed by the waveguide corporate feed network 44 in FIG. 8. The assembly of these three types of components forms the passive transmit array antenna.

The passive array antenna is the mechanical support structure for the TWTAs and multiplexers and performs both thermal and RF radiating functions. The passive array is fed by the multiplexer 20 which is in turn fed by the various TWTAs 24. Depending on the thermal dissipation, heat pipes may be required to provide a more even temperature distribution. The back thermal radiating surface is mechanically attached to the back side of the panel assembly.

Although the embodiment described hereinabove is for a Ku band transmit panel 8 ft. by 8 ft. in size having sixteen TWTAs, it should be obvious to those versed in the art that the panel size could be varied and the number of TWTAs can be varied depending on the design specifics. Such design specifics include panel operating temperature, dissipation per TWTA, type of TWTA (radiatively cooled or conductivity cooled) etc. It should also be obvious to those versed in the art that the same architecture can be used for other frequencies. For example C band transmit panels and Ka band transmit panels can be designed with the same architecture.

The significant feature of the invention is the integration of conventional TWTAs 24 and multiplexers 20 onto passive transmit array antenna panels and deploying these panels out board of the spacecraft bus. It should be noted that the multiplexer 20 may in some cases be replaced by a simple filter or power combiner or both.

The described invention simultaneously provides antenna pattern flexibility in orbit, high DC to RF power conversion efficiency, facilitates higher spacecraft power and helps reduce satellite delivery time. No other payload design provides all these attributes. More particularly the invention provides for in orbit antenna pattern reconfigurability. The deployed payload panel architecture will provide multiple independent beams that can be electronically reconfigured on the ground or in orbit.

The invention also facilitates higher spacecraft power. The deployed payload is constructed from modular deployed panels that radiate all internally generated heat and are thermally isolated from the bus. Consequently payload power does not depend on bus size and can be increased by deploying more payload panels.

The invention will help reduce satellite delivery time. The deployed payload is constructed from modular panels that are composed of standardized parts which can be stock piled. Consequently, the schedule bottlenecks associated with custom designed payloads are eliminated. Large antenna aperture areas that can be stowed into a small launch envelop also provide flexibility in payload configuration.

In the present invention, the DC to RF power conversion efficiency for the deployed payload is greater than or equal to that of a conventional payload because waveguide runs after the TWTAs are shorter in the deployed payload. The DC to RF power conversion efficiency for the deployed payload is much greater than that of a payload with active array transmit antenna. This is due to the much higher power conversion efficiency of TWTAs as compared to SSPAs.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. An electrically reconfigurable passive array antenna panel for radiating thermal energy and transmitting RF signals comprising at least one passive transmit array antenna including a plurality of antenna elements, disposed in said antenna panel, said at least one passive transmit array including a multiplexer means, and a plurality of traveling wave tube amplifiers, located in said panel at positions remote from said antenna elements for providing amplified RF signals to said multiplexer means, said multiplexer means being connected to said at least one passive transmit array antenna wherein said at least one passive transmit array antenna transmits said RF signals and radiates dissipated heat from said electronically reconfigurable passive array antenna panel.

2. The electronically reconfigurable passive array antenna panel according to claim 1 further including at least one RF connector means connected between said traveling wave tube amplifiers and said multiplexer means for coupling amplified RF signals from said traveling wave tube amplifiers to said multiplexer means.

3. The electronically reconfigurable passive array panel according to claim 2 wherein said RF connector means is at least one waveguide.

4. The reconfigurable passive array antenna panel according to claim 1 wherein said antenna panel is mounted on and selectively deployed from a spacecraft bus.

5. The reconfigurable passive array antenna panel according to claim 1 wherein said multiplexer means of said at least one passive transmit array antenna provides a signal for an independent transmitted beam of RF signals from said passive array antenna panel.

6. The electronically reconfigurable passive antenna panel according to claim 1 wherein said at least one passive transmit array antenna is coated with thermal control material having high thermal emissivity and low solar absorption.

7. The electronically reconfigurable passive antenna panel according to claim 1 wherein said RF signals have frequencies in the Ku band.

8. The electronically reconfigurable passive antenna panel according to claim 1 wherein said RF signals have frequencies in the Ka band.

9. The electronically reconfigurable passive antenna panel according to claim 1 wherein said RF signals have frequencies in the C band.

10. The electronically reconfigurable passive antenna panel according to claim 1 wherein said at least one passive transmit array antenna includes electronically controlled ferrite phase shift means for reconfiguring the antenna pattern of said at least one transmit array antenna.

* * * * *